US007928944B2

(12) United States Patent
Krijn et al.

(10) Patent No.: US 7,928,944 B2
(45) Date of Patent: Apr. 19, 2011

(54) COLOR-SEQUENTIAL DISPLAY DEVICE

(75) Inventors: Marcellinus Petrus Carolus Michael Krijn, Eindhoven (NL); Oscar Hendrikus Willemsen, Eindhoven (NL); Hans Zou, Windsor, NJ (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 941 days.

(21) Appl. No.: 11/814,084

(22) PCT Filed: Jan. 19, 2006

(86) PCT No.: PCT/IB2006/050199
§ 371 (c)(1),
(2), (4) Date: Jul. 17, 2007

(87) PCT Pub. No.: WO2006/077545
PCT Pub. Date: Jul. 27, 2006

(65) Prior Publication Data

US 2008/0266224 A1 Oct. 30, 2008

(30) Foreign Application Priority Data

Jan. 20, 2005 (EP) ..... 05100334

(51) Int. Cl.
*G09G 3/36* (2006.01)

(52) U.S. Cl. ..... 345/88; 345/691

(58) Field of Classification Search ..... 345/87, 345/88, 89, 94, 204, 690–693
See application file for complete search history.

(56) References Cited

U.S. PATENT DOCUMENTS

| | | | | |
|---|---|---|---|---|
| 4,641,191 | A | 2/1987 | Sutton et al. | |
| 6,263,503 | B1 | 7/2001 | Margulis | |
| 6,568,811 | B2 * | 5/2003 | Noda et al. | 353/31 |
| 6,803,894 | B1 * | 10/2004 | Hirota et al. | 345/88 |
| 6,809,717 | B2 * | 10/2004 | Asao et al. | 345/102 |
| 7,106,276 | B2 * | 9/2006 | Akiyama | 345/39 |
| 7,123,222 | B2 * | 10/2006 | Borel et al. | 345/88 |
| 7,170,482 | B2 * | 1/2007 | Okita | 345/88 |
| 7,248,244 | B2 * | 7/2007 | Akiyama | 345/102 |

(Continued)

FOREIGN PATENT DOCUMENTS

EP 0997868 A1 5/2000

(Continued)

OTHER PUBLICATIONS

Fisher-Price; Laugh & Learn Anleitung, 2004, Fisher Price, XP002382163, p. 2.

*Primary Examiner* — Regina Liang
*Assistant Examiner* — Tom V Sheng

(57) ABSTRACT

A display arrangement comprises a plurality of pixel elements (FLCD) that have controllable light-transfer characteristics. A display driver controls the plurality of pixel elements in accordance with a color component (R) during a control interval (TO) that is assigned to the color component. The display driver causes a color-light source (RL1, RL2) to apply a color light, which corresponds to the color component, to the plurality of pixel elements during a main interval (RMO). The main interval is comprised in the control interval that is assigned to color component. The light-source controller also causes the color-light source to apply the color light during a spillover interval (RS1, RS2). The spillover interval is comprised in another control interval (T1) that is assigned to another color component (G).

13 Claims, 8 Drawing Sheets

U.S. PATENT DOCUMENTS

| | | | | |
|---|---|---|---|---|
| 7,365,729 | B2 * | 4/2008 | Hong | 345/102 |
| 7,483,010 | B2 * | 1/2009 | Bai et al. | 345/88 |
| 7,714,829 | B2 * | 5/2010 | Drader et al. | 345/102 |
| 2002/0060662 | A1 | 5/2002 | Hong | |
| 2002/0063670 | A1 | 5/2002 | Yohinaga et al. | |
| 2002/0113761 | A1 | 8/2002 | Mizutani et al. | |
| 2003/0046685 | A1 | 3/2003 | Srinivasan et al. | |
| 2003/0107675 | A1 | 6/2003 | Dew et al. | |
| 2004/0130555 | A1 * | 7/2004 | Ko et al. | 345/589 |

FOREIGN PATENT DOCUMENTS

| | | |
|---|---|---|
| EP | 0749250 B1 | 4/2002 |
| EP | 1347652 A2 | 9/2003 |
| GB | 2248001 A | 3/1992 |
| GB | 2335776 A | 9/1999 |

* cited by examiner

DDC

COLOR-SEQUENTIAL DISPLAY DEVICE

FIELD OF THE INVENTION

An aspect of the invention relates to a display arrangement that comprises a plurality of pixel elements that have controllable light-transfer characteristics. A ferroelectric-liquid-crystal-device (FLCD) may form, for example, the plurality of pixel elements. A multicolor-light source may apply one or more different color lights to the plurality of pixel elements in a time-sequential manner. Other aspects of the invention relate to an image-display method, a computer-program product for a display arrangement, and a video apparatus.

DESCRIPTION OF PRIOR ART

United States patent application published under number US 2002/0113761 describes a field-sequential type liquid crystal display apparatus. The apparatus includes a liquid-crystal display device in which unit-color image data of different colors are sequentially written in display elements during the period of one frame composed of three continuous fields. An illuminating unit, which is placed at the back of the liquid crystal display device, sequentially emits light beams having colors corresponding to the colors of the unit-color image data in accordance with the sequential write of the unit-color image data. The illuminating unit is selectively controlled to sequential turn-on of colors, total turn-off by which the emission of all the light beams is stopped, or total turn-on. A semitransparent reflecting film is formed between the liquid crystal display device and the illuminating unit.

SUMMARY OF THE INVENTION

According to an aspect of the invention, a display arrangement has the following characteristics. The display arrangement comprises a plurality of pixel elements that have controllable light-transfer characteristics. A display driver controls the plurality of pixel elements in accordance with a color component during a control interval that is assigned to the color component. The display driver causes a color-light source to apply a color light, which corresponds to the color component, to the plurality of pixel elements during a main interval. The main interval is comprised in the control interval that is assigned to the color component. The light-source controller also causes the color-light source to apply the color light during a spillover interval. The spillover interval is comprised in another control interval that is assigned to another color component.

The invention takes the following aspects into consideration. In a color-sequential display arrangement, a controller controls a matrix of pixel elements in accordance with one color component during one time interval, and in accordance with another color component during another time interval. Typically, there are three color components: red, green, and blue. In that case, there will be a red-control interval for the red component, a green-control interval for the green component, and a blue-control interval for the blue component. These control intervals for the matrix of pixel elements are distinct and do not overlap. A multicolor-light source applies red light, green light, and blue light to the matrix of pixel elements during a portion of the red-control interval, green-control interval, and blue-control interval, respectively.

The color-sequential display arrangement will display an image with certain brightness. This image brightness depends on respective intensities of the different color lights that the multicolor-light source provides, which different color lights are typically red, green, and blue, as mentioned hereinbefore. The image brightness can be increased by increasing the red-light, green-light, and blue-light intensity, which occur during the red-control, green-control, and blue-control interval, respectively. However, the color-sequential display arrangement will consume more power. In the aforementioned fashion, the image brightness can be increased with X % at the expense of Y % more consumption.

We have observed the following phenomena. Let a light source be considered that is switched on during a given percentage of time in an interval of 100 milliseconds. Such a time interval typically comprises a few numbers of consecutive field periods in a color-sequential image display. Let it be assumed that the given percentage of time during which the light source is switched on, is increased by Y %. Power consumption will equally increase by Y %. We observed that the light source provided Z % more light within the interval of time, with Z % being greater than X %, which was the brightness gain mentioned hereinbefore. Consequently, in order to increase brightness, it is more power-efficient to increase the percentage of time when a light source is switched on, than to increase the intensity of the light source In accordance with the aforementioned aspect of the invention, the light-source controller causes the color-light source to apply a color light, which corresponds to the color component, to the plurality of pixel elements during the main interval and, in addition, the spillover interval.

Accordingly, the invention allows the color-light source to produce light of a given intensity for a greater percentage of time. It has been explained hereinbefore that it is more power-efficient to increase the percentage of time when a light source is switched on, than to increase the intensity of the light source. Consequently, the invention allows power-efficiency.

Another advantage of the invention relates to the following aspects. In certain applications, it may prove not to be practical to increase an intensity of light that a light source produces. For example, it may prove to be necessary to change a light-source design or to change a light-source type. This takes time and, as a result, introduces additional costs. The invention allows an image-brightness increase that does not require a light-intensity increase. For those reasons, the invention allows cost-efficiency.

The spillover interval may cause an image to appear somewhat differently compared with a conventional technique, in which there is no spillover interval. For example, an image that is displayed with spillover intervals may have less saturated colors. In many cases, this will be more than acceptable or even unnoticeable. There are many images that have moderately saturated colors, in particular natural images. Saturated colors are unnatural. The spillover interval will hardly affect such images. It is also possible to compensate for the spillover interval to certain extent. An image-data processor may provide appropriate color correction.

These and other aspects of the invention will be described in greater detail hereinafter with reference to drawings.

DETAILED DESCRIPTION

Figure 1:
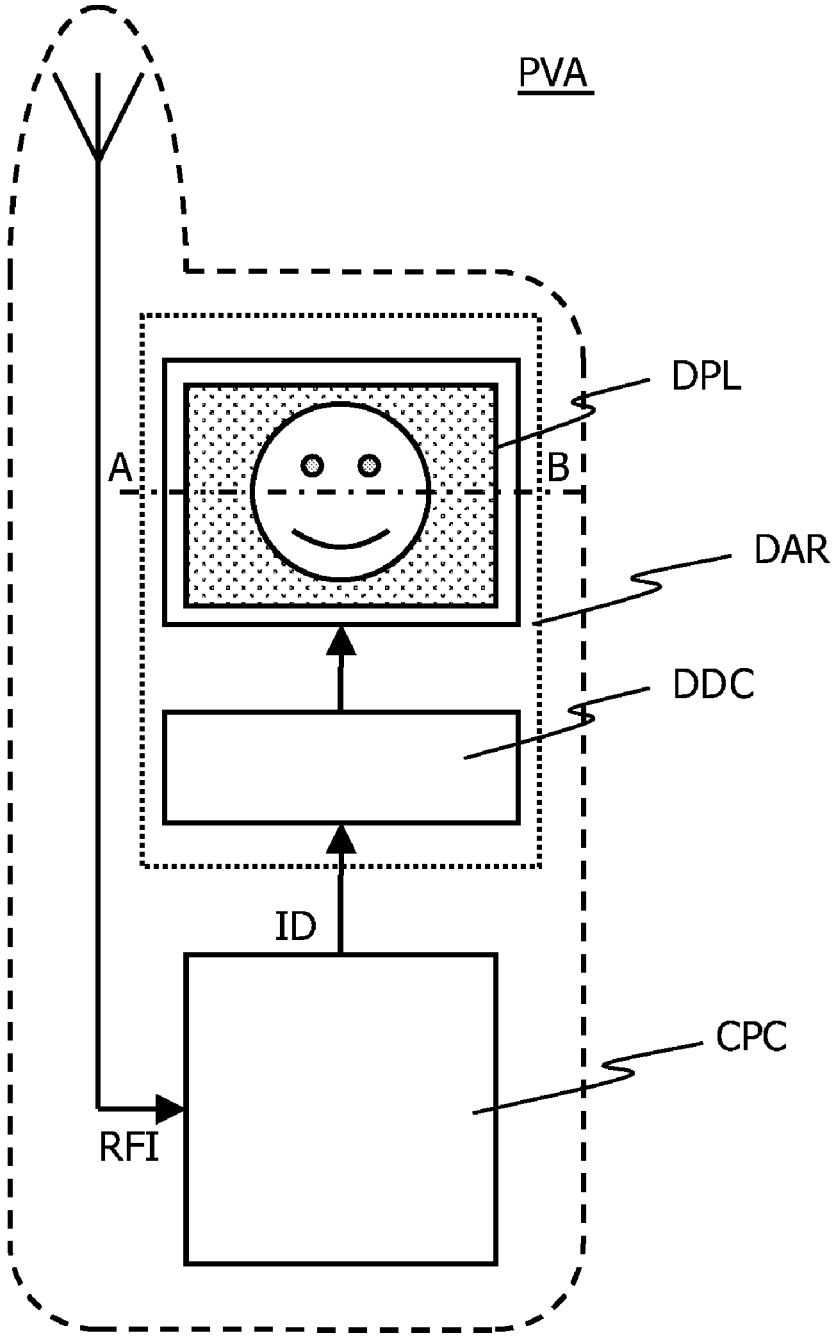
FIG. 1 is a block diagram that illustrates a portable video apparatus.

FIG. 1 illustrates a portable video apparatus PVA. The portable video apparatus PVA may be, for example, a cellular phone or a personal digital assistant (PDA). The portable video apparatus PVA comprises a display arrangement DAR and a communication-and-processing circuit CPC. The display arrangement DAR comprises a display device DPL and a display-driver circuit DDC.

The display arrangement DAR displays a color image on the basis of multichrome image data ID that the communication-and-processing circuit CPC provides. The communication-and-processing circuit CPC may derive the multichrome image data ID, for example, from a radiofrequency signal RFI that the portable video apparatus PVA receives. For example, a base station of a cellular phone network may transmit the radiofrequency signal RFI to the portable video apparatus PVA. As another example, the radiofrequency signal RFI may originate from a wireless local area network.

Figure 2:
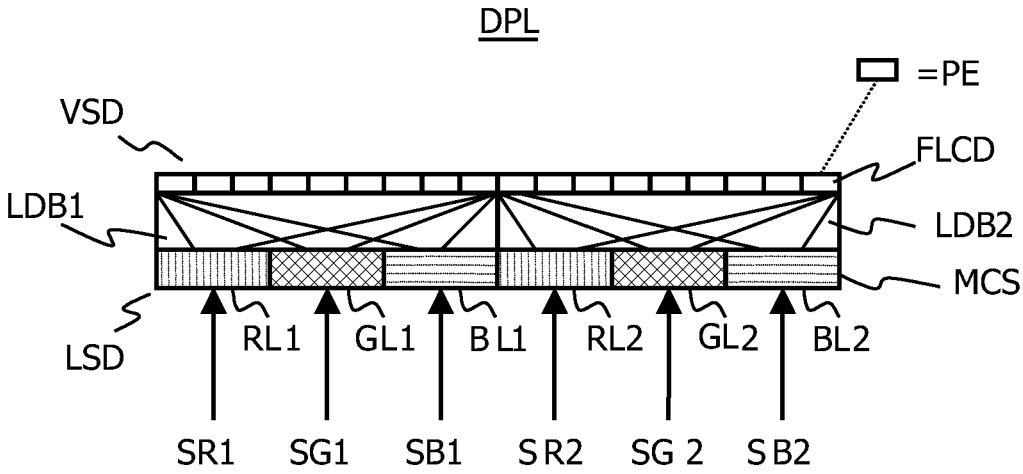
FIG. 2 is a cross-section diagram that illustrates a display device of the portable video apparatus.

FIG. 2 illustrates the display device DPL in a cross section along a line A-B shown in FIG. 1. The display device DPL has a viewing side VSD and a lighting side LSD. The display device DPL comprises a ferroelectric-liquid-crystal device FLCD, which is on the viewing side VSD. The ferroelectric-liquid-crystal device FLCD comprises various pixel elements PE represented as small rectangles. The display device DPL further comprises light distributors LDB1, LDB2 and a multicolor-light source MCS. The multicolor-light source MCS comprises red light sources RL1, RL2, green light sources GL1, GL2, and blue light sources BL1, BL2. The aforementioned light sources are on the lighting side LSD. The light sources may be in the form of, for example, light emitting diodes of corresponding color.

Red light control signals SR1, SR2 activate red light sources RL1, RL2, respectively. Red light source RL1 can thus be activated independent of red light source RL2, and vice versa. The same applies to green light sources GL1, GL2 and blue light sources BL1, BL2. Green light control signals SG1, SG2 and blue light control signals SB1, SB2 activate green light sources GL1, GL2 and blue light sources BL1, BL2, respectively.

Light distributor LDB1 evenly distributes red light, green light, and blue light from red light source RL1, green light source GL1, and blue light source BL1, respectively, over a left hand portion of the ferroelectric-liquid-crystal device FLCD, which FIG. 2 illustrates. Similarly, light distributor LDB2 evenly distributes red light, green light, and blue light from red light source RL2, green light source GL2, and blue light source BL2, respectively, over a right hand portion of the ferroelectric-liquid-crystal device FLCD.

The ferroelectric-liquid-crystal device FLCD has controllable light-transmission characteristics. Consequently, the ferroelectric-liquid-crystal device FLCD determines to which extent light, which is produced on the lighting side LSD, reaches the viewing side VSD.

Let it be assumed, for example, that the red light sources RL1, RL2 are activated for at least one second, whereas the other light sources are not active. Let it further be assumed that the ferroelectric-liquid-crystal device FLCD is controlled so that it is entirely transparent. In that case, red light, which the red light sources RL1, RL2 produce, will reach the viewing side VSD. The display device DPL will display an image that is a relatively bright, red rectangle. Conversely, the display device DPL will be black if the ferroelectric-liquid-crystal device FLCD is controlled so that it is entirely opaque.

There can be numerous different degrees of transparency between these two extremes. What is more, light-transmission characteristics can be controlled per pixel element. One or more portions of the ferroelectric-liquid-crystal device FLCD can be made transparent, whereas other portions of the ferroelectric-liquid-crystal device FLCD can be made opaque.

Figure 3:
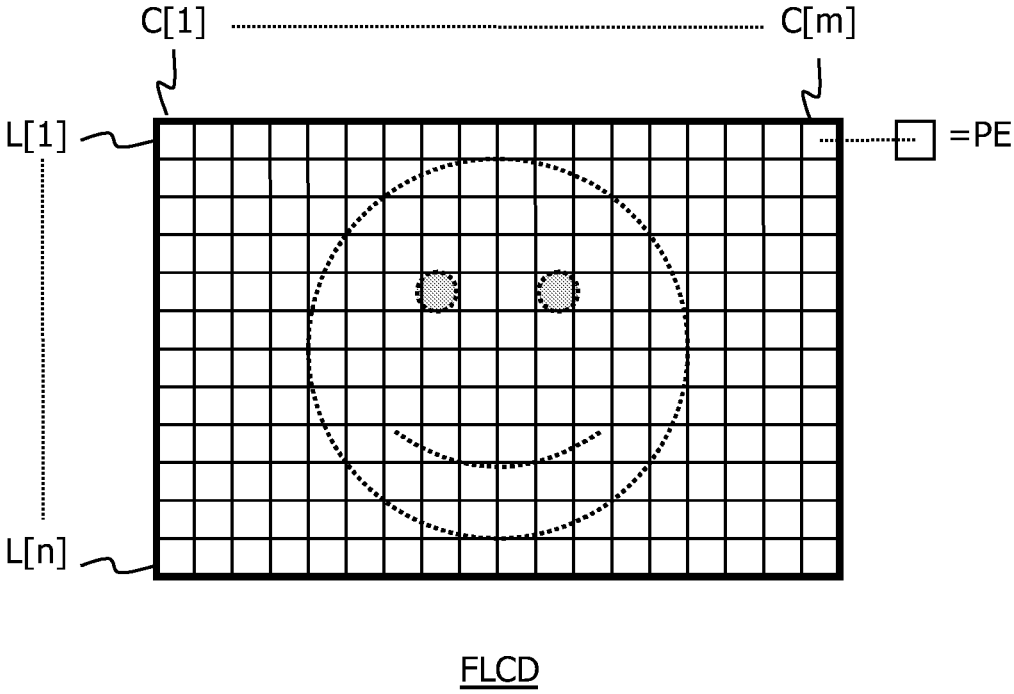
FIG. 3 is a diagram that illustrates the ferroelectric-liquid-crystal device that forms part of the display device.

FIG. 3 illustrates the ferroelectric-liquid-crystal device FLCD. The ferroelectric-liquid-crystal device FLCD comprises a plurality of lines comprised between a first line L[1] and a last line L[n], and a plurality of columns comprised between a first column C[1] and a last column C[m]. A variable "n" denotes the number of lines; a variable "m" denotes the number of columns. The lines and columns define a matrix of pixel elements PE. A cell in the matrix corresponds with a pixel element PE. Consequently, a pixel element PE has a unique combination of a line number and a row number. The pixel element PE can individually be addressed by means of the line number and the row number that belong to the pixel element PE. The light-transmission characteristics of the pixel element PE can be controlled when the pixel element PE is addressed. Accordingly, the light-transmission characteristics of respective pixel element PE can be controlled individually, in a pixel element by pixel element manner.

Figure 4:
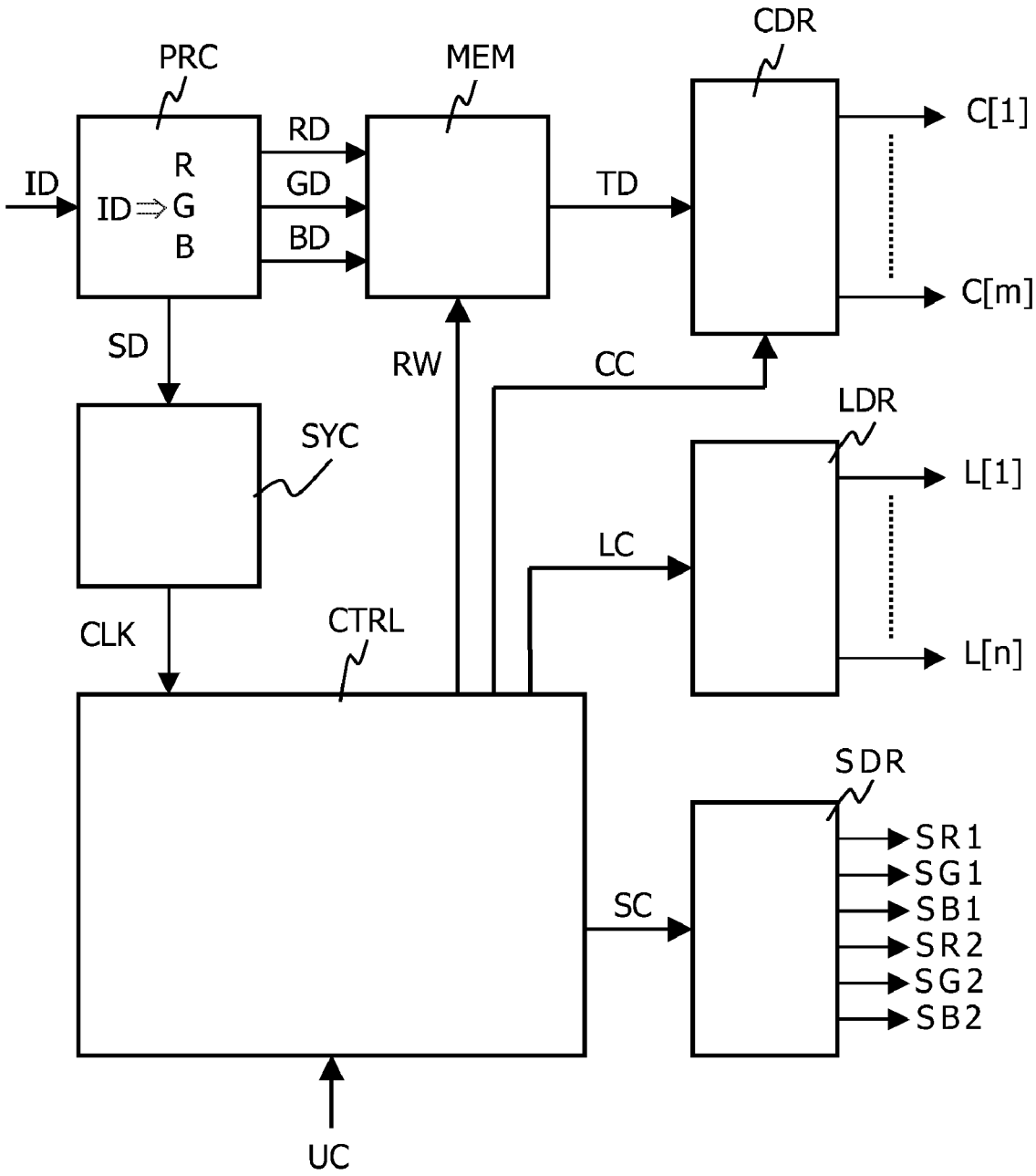
FIG. 4 is a block diagram that illustrates a display-driver circuit of the portable video apparatus.

FIG. 4 illustrates the display-driver circuit DDC. The display-driver circuit DDC comprises an image-data processor PRC, a memory MEM, a synchronization circuit SYC, and a controller CTRL. The controller CTRL has an input for receiving a user command UC. The controller may be in the form of, for example, an assembly of logic circuits, which is a hardware-base implementation. Alternatively, the controller may in the form of a suitably programmed computer, which is a software-based implementation. A hybrid implementation, in which both hardware and software define various functions, is also possible.

The display-driver circuit DDC further comprises a column driver CDR and a line driver LDR for the ferroelectric-liquid-crystal device FLCD. The column driver CDR can activate a particular column and the line driver LDR can activate a particular line so as to address a particular pixel element PE. The display-driver circuit DDC comprises a light-source driver SDR for the multicolor-light source MCS and the light sources comprised therein. The light-source driver SDR provides the respective light control signals SR1, SG1, SB1, SR2, SG2, SB2, which are also illustrated in FIG. 2.

The display-driver circuit DDC globally operates as follows. The image-data processor PRC derives various color components from the multichrome image data ID: a red component R, a green component G, and a blue component B. The image-data processor PRC provides red-display data RD, green-display data GD, and blue-display data BD, respectively, on the basis of the aforementioned color components.

The memory MEM temporarily stores the aforementioned display data that the image-data processor PRC provides. The memory MEM thus acts as a buffer, which supplies light-transmission-defining data TD to the column driver CDR. The light-transmission-defining data TD is red-display data RD, green-display data GD, or blue-display data BD, which the memory MEM temporarily has stored. The column driver CDR applies the light-transmission-defining data TD to respective pixel elements in a manner that will be described in greater detail hereinafter.

The image-data processor PRC further derives synchronization data SD from the multichrome image data ID. The synchronization circuit SYC establishes a clock signal CLK on the basis of the synchronization data SD, which is comprised in the multichrome image data ID. The clock signal CLK may be a composite signal that comprises various synchronization signals such as, for example, signals for line and field synchronization.

The controller CTRL is the heart of the display-driver circuit DDC. The controller CTRL provides various control signals: a read-write control signal RW for the memory MEM, a column-driver control signal CC for the column driver CDR, a line-driver control signal LC for the line driver LDR, and a light-source-driver control signal SC for light-source driver SDR. The controller CTRL establishes these control signals on the basis of the clock signal CLK, which the synchronization circuit SYC provides. The aforementioned control signals impose a particular timing, which substantially determines display properties. This timing will be explained in greater detail hereinafter.

Figure 5:
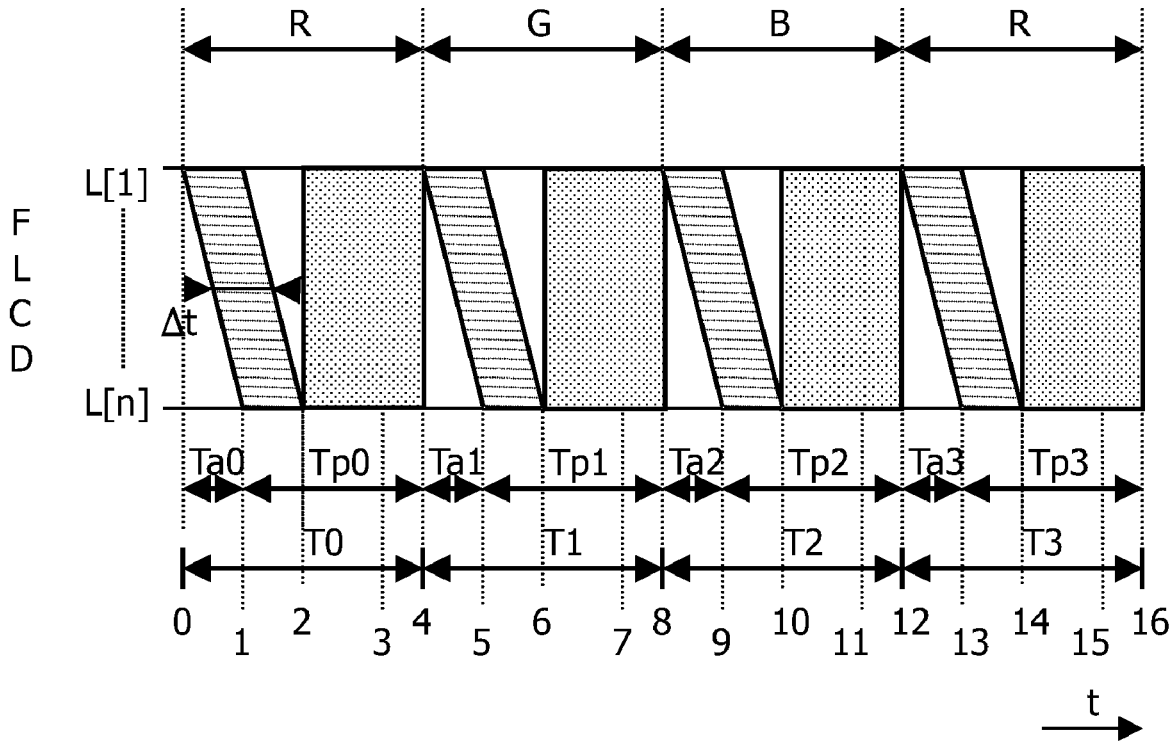
FIG. 5 is a time diagram that illustrates a control scheme for the ferroelectric-liquid-crystal device.

FIG. 5 illustrates a control scheme for the ferroelectric-liquid-crystal device FLCD, which the display-driver circuit DDC provides. FIG. 5 has a horizontal axis that represents time. A reference numeral denotes a particular instant. Various different instants 0-16 are illustrated.

FIG. 5 illustrates various control intervals T0, T1, T2, T3. In a control interval, the display-driver circuit DDC controls the ferroelectric-liquid-crystal device FLCD in accordance with a particular color component. That is, a particular color component has a particular control interval. FIG. 5 has an upper line that illustrates respective color components R, G, B to which the respective control intervals belong. The red component R has control interval T0, which is comprised between instant 0 and instant 4, and control interval T3 which is comprised between 12 and 16. The green component G has control interval T1, which is comprised between instant 4 and instant 8. The blue component B has control interval T2, which is comprised between instant 8 and instant 12. The display-driver circuit DDC thus controls the ferroelectric-liquid-crystal device FLCD in accordance with the respective color components R, G, B in a time-sequential, alternate fashion.

Control interval T0 has a length that depends on the multichrome image data ID. The multichrome image data ID has a certain image rate. The length of control interval T0 depends on the image rate, which is typically comprised between 25 and 50 images per second. An image may comprise two different fields: and odd-line field and an even-line field. In that case, the multichrome image data ID has a field frequency that is typically comprised between 50 and 100 Hertz, which corresponds to a field period typically comprised between 10 and 20 milliseconds. Control interval T0 typically has a length that is approximately one third of the field period. The aforementioned equally applies to the other control intervals T1, T2, T3. The respective control intervals T0, T1, T2, T3 need not have an identical length.

FIG. 5 illustrates that control interval T0 has an active sub-interval Ta0 and a passive sub-interval Tp0. The same applies to the other control intervals T1, T2, T3. The active sub-interval Ta0 of control interval T0 is comprised between instants 0 and 1, whereas the passive sub-interval Tp0 is comprised between instants 1 and 4. The active sub-interval Ta1 of control interval T1 is comprised between instants 4 and 5, whereas the passive sub-interval Tp1 is comprised between instants 5 and 8. The active sub-interval Ta2 of control interval T2 is comprised between instants 8 and 9, whereas the passive sub-interval Tp2 is comprised between instants 9 and 12. The active sub-interval Ta3 of control interval T3 is comprised between instant 12 and instant 13, whereas the passive sub-interval Tp3 is comprised between 13 and 16.

The display-driver circuit DDC addresses pixel elements during the active sub-interval Ta0 of control interval T0 so as to control the light transmission properties of the pixel elements, which are addressed. The display-driver circuit DDC addresses pixel elements in a line-at-a-time manner. For example, the display-driver circuit DDC activates the first line L[1] at instant 0. The display-driver circuit DDC then activates various columns so as to address pixel elements on the first line L[1]. Subsequently, the display-driver circuit DDC activates a subsequent line and activates various columns so as to address pixel elements on the subsequent line.

The display-driver circuit DDC continues this line-wise addressing until the last line L[n]. The display-driver circuit DDC has finished addressing pixel elements at the last line L[n] at instant 1. Consequently, the display-driver circuit DDC has finished addressing pixel elements at instant 1. The display-driver circuit DDC has programmed the light-transmission characteristics of the pixel elements in accordance with red-display data RD. The display-driver circuit DDC programs the ferroelectric-liquid-crystal device FLCD in the active sub-intervals Ta1, Ta2, Ta3 of control intervals T1, T2, T3 in a similar manner in accordance with green-display data GD, blue-display data BD and anew with red-display data RD, respectively.

In the passive sub-interval Tp0 of control interval T0, the display-driver circuit DDC allows the pixel elements of the ferroelectric-liquid-crystal device FLCD to achieve and, subsequently, maintain the light-transmission characteristics, which have been programmed in accordance with red-display data RD in the active sub-interval Ta0. The same applies to the passive sub-intervals Tp1, Tp2, Tp3 of control intervals T1, T2, T3, wherein the light-transmission characteristics are in accordance with green-display data GD, blue-display data BD, and red-display data RD anew, respectively.

FIG. 5 illustrates that the ferroelectric-liquid-crystal device FLCD has a certain response time Δt. A pixel element does not immediately have light-transmission characteristics that correspond with display data that the display-driver circuit DDC applies when addressing the pixel element. It requires a certain time for the pixel element to achieve the light-transmission characteristics. There is a certain delay, which is the response time Δt. For example, the display-driver circuit DDC has just finished applying red-display data RD to a last pixel element on the last line L[n] at instant 1. This last pixel element will achieve the light-transmission characteristics that correspond with red-display data RD at instant 2. The response time Δt is a delay that extends from instant 1 to instant 2.

The light-transmission characteristics of the ferroelectric-liquid-crystal device FLCD vary between instant 0 and instant 2. The light-transmission characteristics vary between instant 0 and instant 1 because the display-driver circuit DDC is programming pixel elements between these instants. The light-transmission characteristics vary between instant 1 and instant 2 because the ferroelectric-liquid-crystal device FLCD adapts to red-display data RD that has been programmed. The light-transmission characteristics of the ferroelectric-liquid-crystal device FLCD are relatively stable between instant 2 and instant 4. The light-transmission characteristics are in accordance with red-display data RD between these instants.

Similarly, the light-transmission characteristics vary between instant 4 and instant 6. The ferroelectric liquid crystal device FLCD undergoes a transition from red-display data RD to green-display data GD. The light-transmission characteristics are in accordance with green-display data GD between instant 6 and 8. The light-transmission characteristics vary between instant 8 and 10 because there is a transition from green-display data GD to blue-display data BD. The light-transmission characteristics are in accordance with blue-display data BD between instant 10 and instant 12. Light-transmission characteristics vary between instant 12 and instant 14 because there is transition from blue-display data BD to red-display data RD. The light-transmission characteristics are anew in accordance with the red-display data RD between instant 14 and 16.

Figure 6:
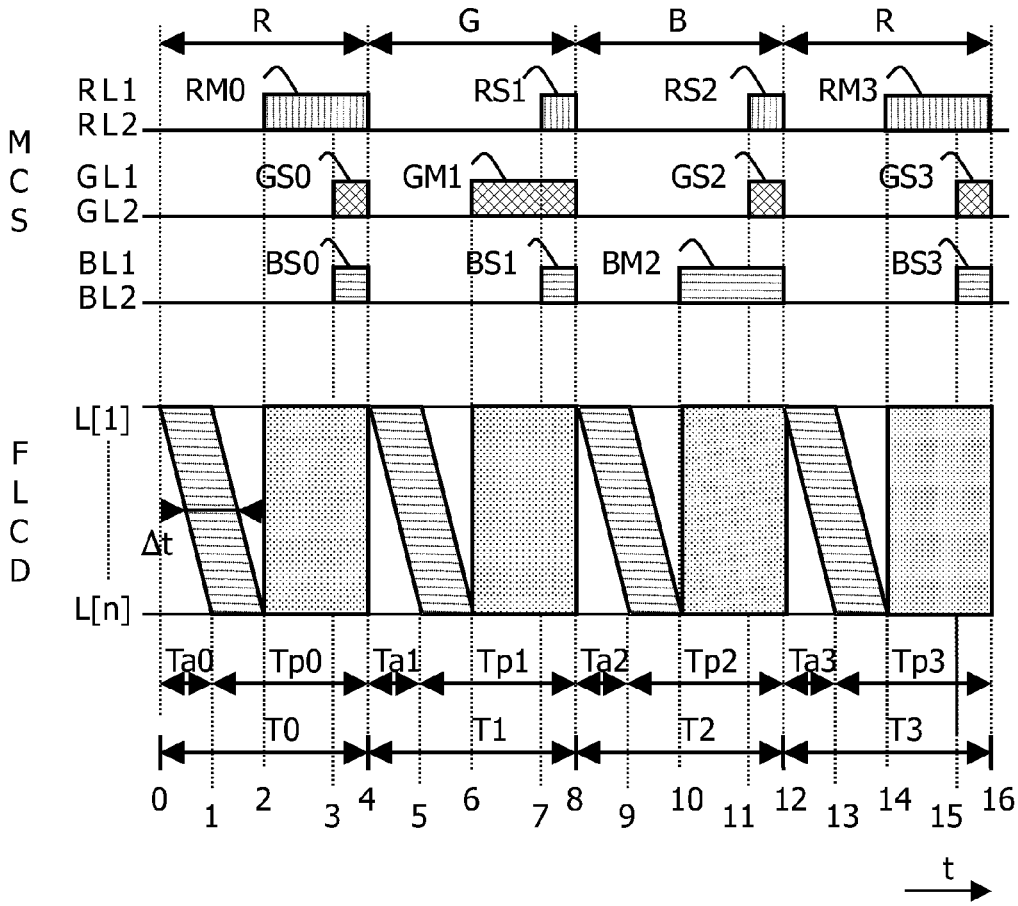
FIG. 6 is a time diagram that illustrates first control scheme for the display device.

FIG. 6 illustrates a first control scheme for the display device DPL, which comprises the multicolor-light source MCS and the ferroelectric-liquid-crystal device FLCD. FIG. 6 is an extension of FIG. 5. FIG. 6 has a lower portion, which corresponds to FIG. 5 and an upper portion that relates to the multicolor-light source MCS. The upper portion illustrates when the display-driver circuit DDC activates the respective light sources. In this example, the display-driver circuit DDC activates light sources of the same color simultaneously.

FIG. 6 illustrates that the display-driver circuit DDC activates the red light sources RL1, RL2 during red main intervals RM0, RM3 and during red spillover intervals RS1, RS2. FIG. 6 further illustrates that the display-driver circuit DDC activates the green light sources GL1, GL2 during green main interval GM1 and green spillover intervals GS0, GS2, GS3. The display-driver circuit DDC activates the blue light sources BL1, BL2 during blue main interval BM2 and blue spillover intervals BS0, BS1, BS3.

Red main intervals RM0, RM3 occur within control intervals T0, T3, respectively, which belong to the red component R of the multichrome image data ID as explained hereinbefore. The display-driver circuit DDC controls the ferroelectric-liquid-crystal device FLCD in accordance with the red component R in these control intervals. Consequently, in red main intervals RM0, RM3, the red light sources RL1, RL2 are activated when the display-driver circuit DDC controls the ferroelectric-liquid-crystal device FLCD in accordance with the component of corresponding color, which is red.

Red spillover intervals RS1, RS2 occur within control intervals T1, T2, which belong to the green component G and blue component B, respectively, as explained hereinbefore. The display-driver circuit DDC controls the ferroelectric-liquid-crystal device FLCD in accordance with the green component G and the blue component B, respectively, in these control intervals. Consequently, in the red spillover intervals, the red light sources RL1, RL2 are activated when the display-driver circuit DDC controls the ferroelectric-liquid-crystal device FLCD in accordance with multichrome image data ID components of different color, which different colors are green and blue.

The aforementioned applies in like fashion to green main interval GM1 and the green spillover intervals GS0, GS2, GS3, and blue main interval BM2 and the blue spillover intervals BS0, BS1, BS3.

In control interval T0, the display-driver circuit DDC activates the red light sources RL1, RL2 during red main interval RM0, which extends from instant 2 to instant 4. In addition, the display-driver circuit DDC activates the green light sources GL1, GL2 and the blue light sources BL1, BL2 during green spillover interval GS0 and blue spillover interval BS0, respectively, which extend from instant 3 to instant 4. As a result, the ferroelectric-liquid-crystal device FLCD will substantially receive red light between instants 2 and 3. The ferroelectric-liquid-crystal device FLCD will substantially receive a mixture of red, green, and blue light. This mixture constitutes substantially white light. Similarly, in control interval T3, the ferroelectric-liquid-crystal device FLCD will substantially receive red light between instants 14 and 15, and substantially white light between instants 15 and 16.

In control interval T1, the display-driver circuit DDC activates the green light sources GL1, GL2 during green main interval GM1, which extends from instant 6 to instant 8. In addition, the display-driver circuit DDC activates the red light sources RL1, RL2 and the blue light sources BL1, BL2 during red spillover interval RS1 and blue spillover interval BS1, respectively, which extend from instant 7 to instant 8. As a result, the ferroelectric-liquid-crystal device FLCD will substantially receive green light between instants 6 and 7, and substantially white light between instants 7 and 8.

In control interval T2, the display-driver circuit DDC activates the blue light sources BL1, BL2 during the blue main interval BM2, which extends from instant 10 to instant 12. In addition, the display-driver circuit DDC activates the red light sources RL1, RL2 and the green light sources GL1, GL2 during red spillover interval RS2 and green spillover interval GS2, respectively, which extend from instant 11 to 12. As a result, the ferroelectric-liquid-crystal device FLCD will substantially receive blue light between instants 10 and 11, and substantially white light between instants 11 and 12.

In summary, in a control interval that belongs to a particular color component, the display-driver circuit DDC causes the multicolor-light source MCS to provide two different types of light in a time sequential fashion. One type of light corresponds with the color component to which the control interval belongs. The other type of light is white light in this example. The ferroelectric-liquid-crystal device FLCD thus receives the color corresponding to the color component for a portion of time, and receives white color during another portion of time.

The first control scheme, which is illustrated in FIG. 6, provides the following visual effects. The display device DPL, which is illustrated in FIGS. 1 and 2, will display an image in which colors are less saturated compared with a control scheme that has no spillover intervals. However, since the ferroelectric-liquid-crystal device FLCD receives more light, the image will appear brighter. The longer the spillover intervals are, the brighter the image will appear, but the less the colors will be saturated. For example, in an extreme case, the spillover intervals may have the same length as the main intervals. In this extreme case, the ferroelectric-liquid-crystal device FLCD will receive white light only. There are no colors in the image. However, the image will be bright because the ferroelectric-liquid-crystal device FLCD will receive relatively much light.

The user command UC, which the display-driver circuit DDC receives as illustrated in FIG. 4, determines the length of the respective spillover intervals. Accordingly, a user can cause an image to be brightly displayed with relatively fade colors or, conversely, he or she can cause the image to be less brightly displayed with relatively pronounced colors. The user can select his or her preference. The display-driver circuit DDC may allow the user to vary the length of the respective spillover intervals in a gradual fashion or in discrete steps.

FIG. 6 illustrates the following typical characteristic of the first control scheme. The display-driver circuit DDC activates the respective light sources only when the ferroelectric electric liquid crystal device has relatively stable light-transmission characteristics. It has been explained hereinbefore with reference to FIG. 5 that the ferroelectric-liquid-crystal device FLCD has relatively stable light-transmission characteristics between instants 2 and 4 within control interval T0, between instants 6 and 8 within control interval T1, between instants 10 and 12 within control interval T2, and between instants 14 and 16 within control interval T3. The display-driver circuit DDC activates the respective light sources only within between these instants.

Figure 7:
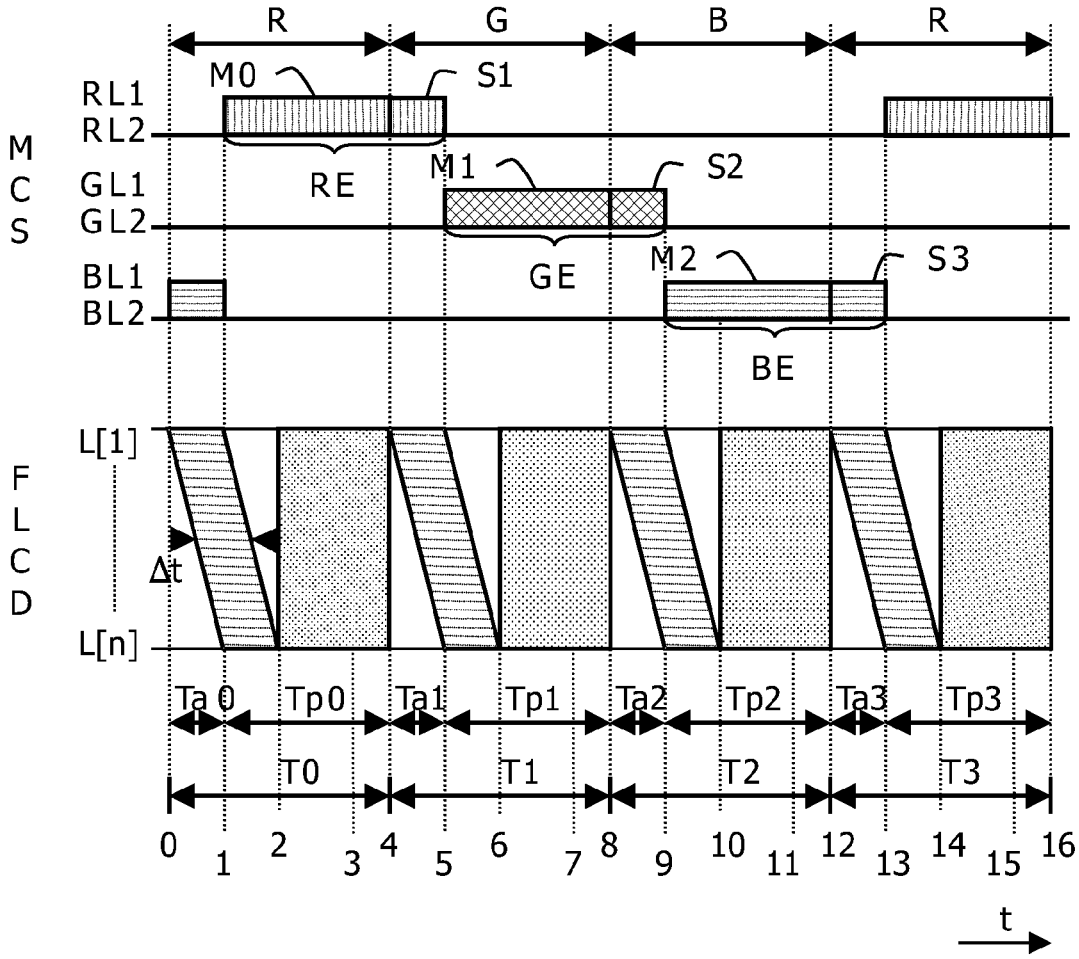
FIG. 7 is a time diagram that illustrates second control scheme for the display device.

FIG. 7 illustrates a second control scheme for the display device DPL. FIG. 7 has a structure that is similar to FIG. 6. FIG. 6 has a lower portion, which corresponds to FIG. 5 and an upper portion that relates to the multicolor-light source MCS. The upper portion illustrates when the display-driver circuit DDC activates the respective light sources. In this example, the display-driver circuit DDC activates light sources of the same color simultaneously, like in the previous example.

FIG. 7 illustrates that the display-driver circuit DDC activates the red light sources RL1, RL2 during red extended interval RE, the green light sources GL1, GL2 during green extended interval GE, and the blue light sources BL1, BL2 during blue extended interval BE. The red extended interval RE has a main portion M0 and a spillover portion S1. The main portion M0 of red extended interval RE is within control interval T0, which belongs to the red component R. More specifically, the main portion M0 corresponds with the passive sub-interval Tp0 of control interval T0. The spillover portion S1 of red extended interval RE is within control interval T1, which belongs to the green component G. More specifically, the spillover portion S1 corresponds with the active sub-interval Ta1 of control interval T1.

Likewise, green extended interval GE has a main portion M1 and a spillover portion S2. The main portion M1 of green extended interval GE is within control interval T1, which belongs to the green component G, whereas the spillover portion S2 of green extended interval GE is within control interval T2, which belongs to the blue component B. The main portion M1 corresponds with the passive sub-interval Tp1 of control interval T1; the spillover portion S2 corresponds with the active sub-interval Ta2 of control interval T2. The blue extended interval BE has a main portion M2 and a spillover portion S3. The main portion of extended blue interval is within control interval, which belongs to the blue component B. The spillover portion S3 of blue extended interval BE is within control interval T3, which belongs to the red component R. The main portion M2 corresponds with the passive sub-interval Tp2 of control interval T2; the spillover portion S3 corresponds with the active sub-interval Ta3 of control interval T3.

FIG. 7 illustrates the following typical characteristic of the second control scheme. The display-driver circuit DDC activates the respective light sources continuously in an alternate fashion. The ferroelectric liquid crystal device FLCD continuously receives light from the multicolor-light source MCS, red, green, or blue. This implies that the ferroelectric-liquid-crystal device FLCD receives light when light-transmission characteristics are varying. It has been explained hereinbefore with reference to FIG. 5 that the ferroelectric-liquid-crystal device FLCD has varying light-transmission characteristics between instants 0 and 2 within control interval T0, between instants 4 and 6 within control interval T1, between instants 8 and 10 within control interval T2, and between instants 12 and 14 and within control interval T3.

For example, in control interval T1, which belongs to the green component G, the ferroelectric-liquid-crystal device FLCD receives red light between instant 4 and instant 5. The display-driver circuit DDC programs the ferroelectric-liquid-crystal device FLCD with green-display data GD in between these instants. The display-driver circuit DDC carries out a line-at-a-time addressing as explained hereinbefore. The display-driver circuit DDC programs the first line L[1] at instant 4. Pixel elements that are addressed on the first line L[1] will adapt to green-display data GD starting from instant 4. There will be a transition from red-display data RD to green-display data GD starting from instant 4 for these pixel elements. A similar transition will start somewhat later for pixel elements that are addressed on the last line L[n]. The transition starts at instant 5 for these pixel elements.

The ferroelectric-liquid-crystal device FLCD receives green light between instant 5 and instant 6. The ferroelectric-liquid-crystal device FLCD adapts to green-display data GD in between these instants. There is a transition from red-display data RD to green-display data GD as mentioned hereinbefore. The pixel elements that have been addressed on the first line L[1] are the first to complete this transition. The pixel elements that have been addressed on the last line L[n] are the last to complete this transition. These pixel elements PE have adapted to green-display data GD at instant 6.

The second control scheme, which is illustrated in FIG. 7, may introduce a certain color error. This is because the ferroelectric-liquid-crystal device FLCD receives light in a transition phase, such as between instants 4 and 6 in the example described hereinbefore. The ferroelectric-liquid-crystal device FLCD receives a certain color light during an initial portion of the transition phase, and receives another color light during an end portion of the transition phase. The color error, if any, depends on whether there is a relatively large transition or relatively small transition in light-transmission characteristics.

Figure 8:
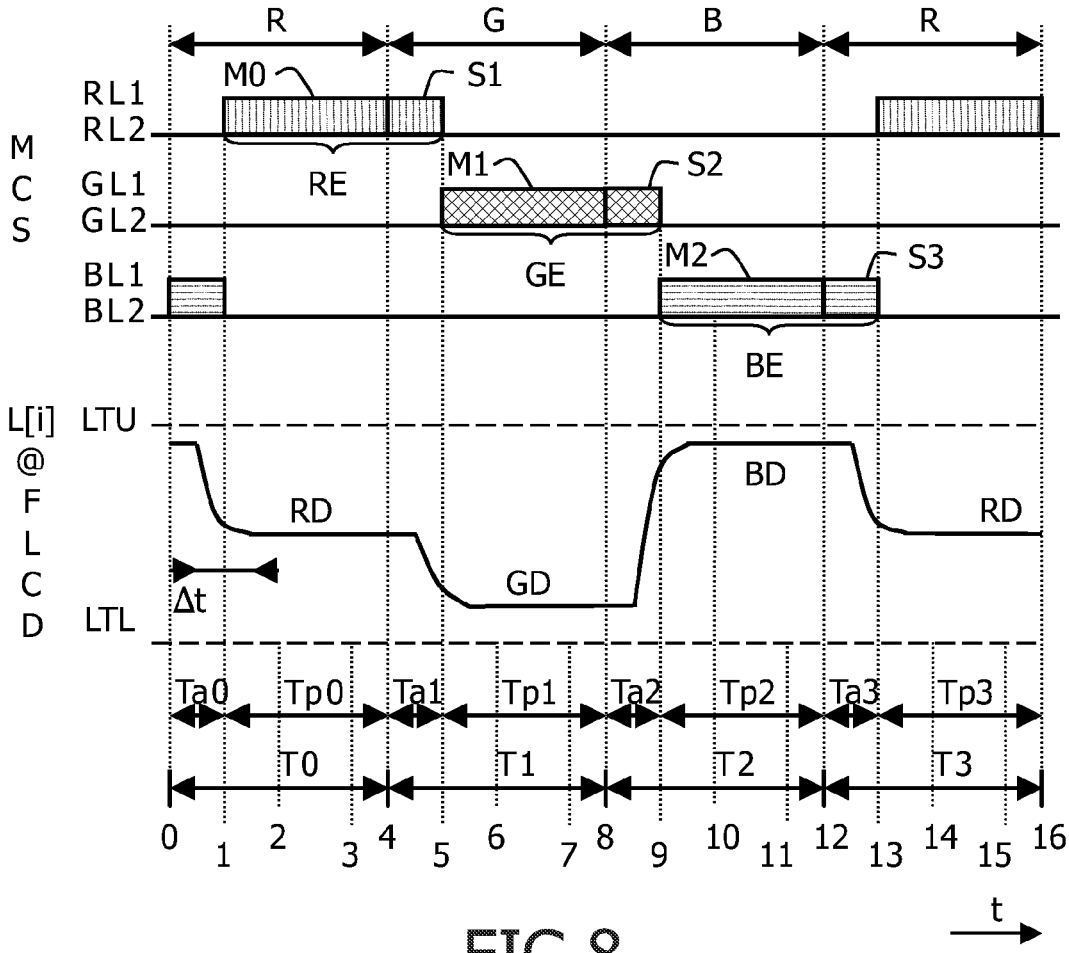
FIG. 8 is a time diagram that illustrates transitions in light-transmission characteristics of the ferroelectric-liquid-crystal device.

FIG. 8 illustrates transitions in light-transmission characteristics of the ferroelectric-liquid-crystal device FLCD. The transitions relate to a pixel element on a middle line L[i]. FIG. 8 comprises various portions that are identical to FIG. 7. FIG. 8 has an upper portion that is identical to that of FIG. 7, which illustrates when the display-driver circuit DDC activates the respective light sources. FIG. 8 further illustrates the respective control intervals T0, T1, T2, T3 and the respective active sub-intervals Ta0, Ta1, Ta2, Ta3 and the respective passive sub-intervals Tp0, Tp1, Tp2, Tp3 comprised therein.

FIG. 8 comprises a graph between an upper-horizontal broken line denoted by LTU and a lower-horizontal broken line denoted by LTL. The upper-horizontal broken line represents LTU maximum light-transmission characteristics for the pixel element on the middle line L[i]. This corresponds to the pixel element being substantially transparent. The lower-horizontal broken line LTL represents minimum light-transmission characteristics, which corresponds to the pixel element being substantially opaque. The graph, which is present in between the aforementioned horizontal broken lines, represents the light-transmission characteristics for the pixel element on the middle line L[i].

FIG. 8 illustrates that the pixel element on the middle line L[i] starts a transition from blue-display data BD to red-display data RD at an instant substantially halfway between instants 0 and 1. The pixel element has completed the transition at an instant substantially halfway between instants 1 and 2. The response time $\Delta t$ is the duration of the transition. FIG. 8 illustrates that red-display data RD defines light-transmission characteristics that are substantially halfway between transparent and opaque. The pixel element has a color that comprises some red component R.

The pixel element PE on the middle line L[i] starts a transition from red-display data RD to green-display data GD at an instant substantially halfway between instants 4 and 5. The pixel element has completed the transition at an instant substantially halfway between instants 5 and 6. FIG. 8 illustrates that green-display data GD defines light-transmission characteristics that are relatively close to opaque. The pixel element has a color that comprises not much green component G.

The pixel element on the middle line L[i] starts a transition from green-display data GD to blue-display data BD at an instant substantially halfway between instants 8 and 9. The pixel element has completed the transition at an instant substantially halfway between instants 9 and 10. FIG. 8 illustrates that blue-display data BD defines light-transmission characteristics that are relatively close to transparent. The pixel element has a color that comprises much blue component B. Consequently, the pixel element has a color that can be described as much blue, some red, and not so much green.

FIG. 8 illustrates that red-display data RD does not exclusively define the light-transmission characteristics of the pixel element during the red extended interval RE, when the pixel element receives red light. Blue-display data BD and green-display data GD define the light-transmission characteristics of the pixel element too, when the pixel element receives red light. This is due to the transition from blue-display data BD to red-display data RD, and the transition from red-display data RD to green-display data GD described hereinbefore. The light-transmission characteristics of the pixel element have not yet adapted to red-display data RD at instant 1, which marks the start of the red extended interval RE. The light-transmission characteristics of the pixel element have already started to adapt to green-display data GD at instant 5, which marks the end of the red extended interval RE. Consequently, the pixel element will have an amount of red that depends not only on red-display data RD, but also on blue-display data BD and green-display data GD. In the example that FIG. 8 illustrates, the amount of red will be about right because the transition near instant 1 and that near instant 5 have opposite directions and compensate each other to certain extent.

In a similar fashion, green-display data GD does not exclusively define the light-transmission characteristics of the pixel element during the green extended interval GE, when the pixel element receives green light. The pixel element will have an amount of green that depends not only on green-display data GD, but also on red-display data RD, which affects the light-transmission characteristics at instant 5 and blue-display data BD, which affects light-transmission characteristics at instant 9. In the example that FIG. 8 illustrates, there will be too much green.

In a yet similar fashion, blue-display data BD does not exclusively define the light-transmission characteristics of the pixel element during the blue extended interval BE, when the pixel element receives blue light. The pixel element will have an amount of blue that depends not only on blue-display data BD, but also on green-display data GD, which affects the light-transmission characteristics at instant 9 and red-display data RD, which affects light-transmission characteristics at instant 13. In the example that FIG. 8 illustrates, there will be insufficient blue.

Figure 9:
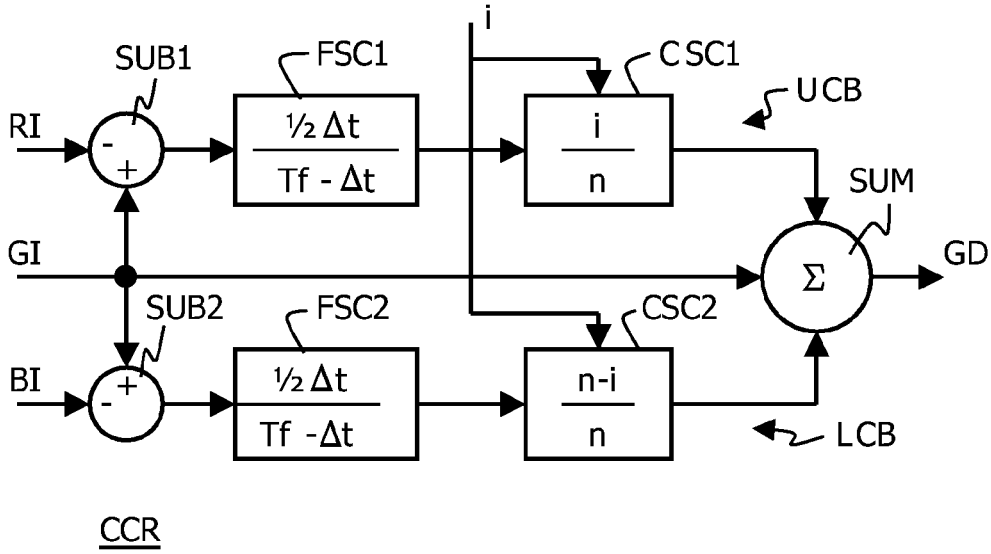
FIG. 9 is a block diagram that illustrates a color corrector which the display-driver circuit may include.

FIG. 9 illustrates a color corrector CCR, which can substantially prevent color errors as described hereinbefore. The color corrector CCR may be included in the image-data processor PRC, which is illustrated in FIG. 4.

FIG. 9 illustrates an example for the color green. The color corrector CCR receives a red-input component RI, a green-input component GI, and a blue-input component BI. These components correspond with red component R, the green component G, and the blue component B, respectively, in the multichrome image data ID. The components relate to a pixel element on the line, whose number is denoted by "i". The color corrector CCR takes into account the line number "i". The color corrector CCR establishes green-display data GD on the basis of these components, which includes a color compensation so as to prevent the color errors as described hereinbefore.

The color corrector CCR comprises two subtraction modules SUB1, SUB2, two fixed scaling modules FSC1, FSC2, two controllable scaling modules CSC1, CSC2, and a summing module SUM. The two fixed scaling modules FSC1, FSC2 provide an identical, fixed scaling factor, which is equal to one half the response time Δt divided by the control interval length Tf minus the response time Δt. This scaling factor thus relates to a significance of the response time Δt relative to the control interval length Tf. The scaling factor will be relatively small if the response time Δt is insignificant relative to the control interval length Tf.

The two controllable scaling modules CSC1, CSC2 provide a variable scaling factor, which depends on the line number "i". The variable scaling factor of controllable scaling module CSC1 is equal to the line number "i" divided by the total number of lines, which is denoted by "n". This variable scaling factor relates to a specific portion of the transition from red-display data RD to green-display data GD near instant 5. It relates to the portion after instant 5 wherein the multicolor-light source MCS applies green light to the ferroelectric-liquid-crystal device FLCD. This portion of the transition is relatively small for a first few lines. This is because pixel elements on the first few lines have substantially adapted to green-display data GD when the display-driver circuit DDC causes the multicolor-light source MCS to switch from red light to green light.

The variable scaling factor of controllable scaling module CSC2 is equal to the total number of lines "n" minus the line number "i" divided by the total number of lines "n". This variable scaling factor relates to a specific portion of the transition from green-display data GD to blue-display data BD near instant 9. It relates to the portion before instant 9 wherein the multicolor-light source MCS applies green light to the ferroelectric-liquid-crystal device FLCD. This portion of the transition is relatively large for the first few lines. This is because pixel elements on the first few lines substantially adapt to blue-display data BD before the multicolor-light source MCS switches from green light to blue light.

The color corrector CCR operates as follows. Subtraction module SUB1, fixed scaling module FSC1, and controllable scaling module CSC1 constitute an upper correction branch UCB. This upper correction branch UCB provides a red-correction component, which is a difference between the green-input component GI and the red-input component RI scaled with fixed scaling factor and, subsequently, with the variable scaling factor. Subtraction module SUB2, fixed scaling module FSC2, and controllable scaling module CSC2 constitute a lower correction branch LCB. This lower correction branch LCB provides a blue-correction component, which is a difference between the green-input component GI and the blue-input component BI scaled with the fixed scaling factor and, subsequently, with the variable scaling factor. The summing module SUM provides green-display data GD, which is a sum of the green-input component GI, the red-correction component and the blue-correction component.

The color corrector CCR operates in a like fashion for the colors red and blue. The upper correction branch UCB, which is illustrated in FIG. 9, will provide a blue-correction component for the color red. The lower correction branch LCB, which is illustrated in FIG. 9, will constitute a green-correction component for the color red. The upper correction branch UCB, which is illustrated in FIG. 9, will provide a green-correction component for the color blue. The lower correction branch LCB, which is illustrated in FIG. 9, will provide a red-correction component for the color blue.

Figure 10:
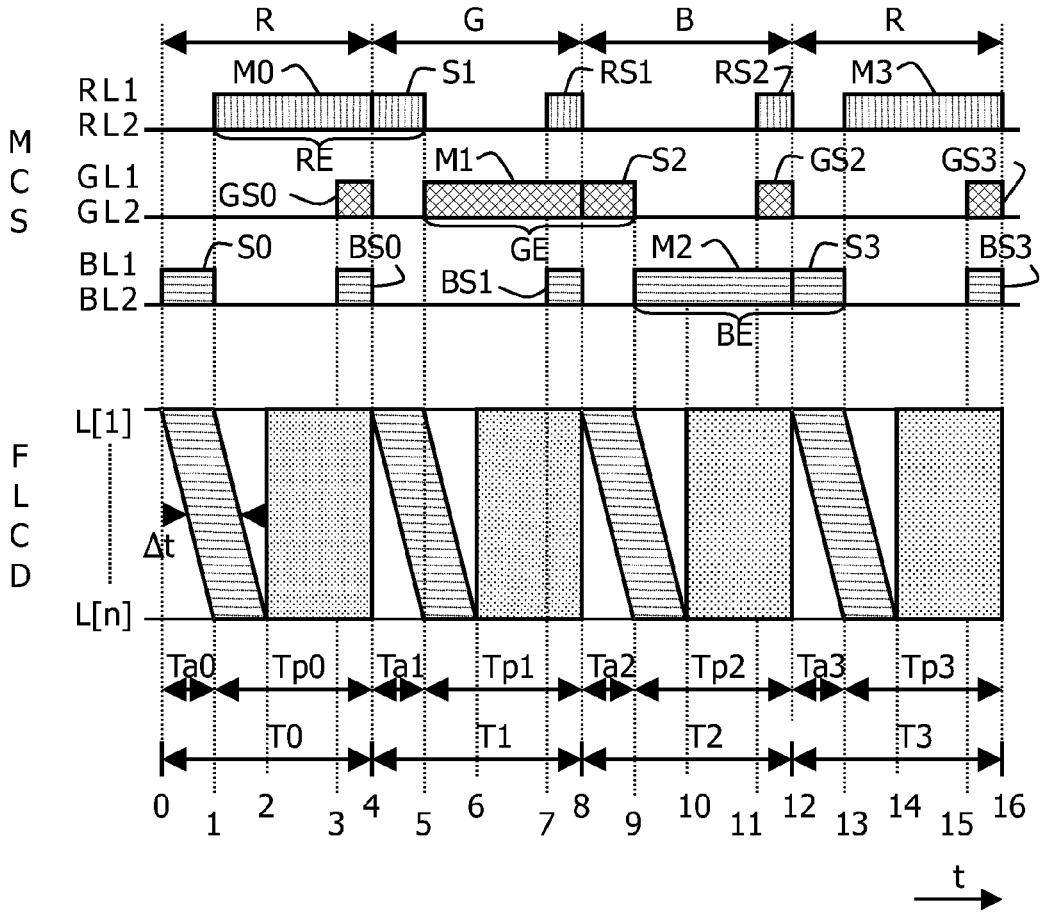
FIG. 10 is a time diagram that illustrates third control scheme for the display device.

FIG. 10 illustrates a third control scheme for the display device DPL. The third control scheme is a combination of the first control scheme, which FIG. 6 illustrates, and the second control scheme, which FIG. 7 illustrates. The remarks that were made with respect to FIG. 6 and FIG. 7 equally apply to FIG. 10. The third control scheme allows the display device DPL to relatively brightly display an image because the ferroelectric-liquid-crystal device FLCD will receive relatively much light from the multicolor-light source MSC. As explained hereinbefore with reference to the first control scheme, which FIG. 6 illustrates, a user can select an appropriate compromise between brightness, on one hand, and color saturation, on the other hand. The display-driver circuit DDC allows the user to vary the length of the respective spillover intervals that FIG. 10 illustrates: red spillover intervals RS1, RS2, green spillover intervals GS0, GS2, GS3, and blue spillover intervals BS0, BS1, BS3.

Referring back to FIG. 2, the display-driver circuit DDC can control red-light source RL1, green-light source GL1, and blue-light source BL1 in accordance with one scheme, whereas the display driver circuit DDC controls red-light source RL2, green-light source GL2, and blue-light source BL2 in accordance with another, different scheme. For example, spillover intervals may be relatively long for the left-hand portion of the ferroelectric liquid crystal device FLCD, whereas spillover intervals are relatively short for the right-hand portion. In that case, the left-hand portion will be relatively bright without much color saturation, or even black and white, whereas the right-hand portion will have relatively much color saturation but will be less bright.

The display-driver circuit DDC may control red-light source RL1, green-light source GL1, and blue-light source BL1 so that respective light intensities of these light sources depend on the multichrome image data ID. The same applies with respect to red-light source RL2, green-light source GL2, and blue-light source BL2. For example, let it be assumed that the multichrome image data ID comprises a relatively dark scene. In that case, the display-driver circuit DDC may decrease the respective light intensities, while adapting the light-transmission-defining data TD in order to compensate for this decrease. For example, let it be assumed that there are 256 different levels for the light-transmission-defining data TD, level 0 corresponding to opaque and level 256 corresponding to transparent. Let it further be assumed that a particular pixel element should have level 10 under standard light-intensity conditions. The display-driver circuit DDC may reduce the respective light intensities by, for example, 50% while increasing the level of the particular pixel element from 10 to 20. This reduces power consumption and increases contrast. The display-driver circuit DDC may also adjust the spillover intervals in dependence on the multichrome image data ID.

Concluding Remarks

The detailed description hereinbefore with reference to the drawings illustrates the following characteristics, which are cited in claim 1. A display arrangement (DAR) comprises a plurality of pixel elements (in the form of ferroelectric-liquid-crystal device FLCD) that have controllable light-transfer characteristics. A display driver (DDC) controls the plurality of pixel elements in accordance with a color component (R, which denotes red, for example) during a control interval (T0) that is assigned to the color component. The display driver (DDC) causes a color-light source (red-light sources RL1, RL2) to apply a color light (red), which corresponds to the color component, to the plurality of pixel elements during a main interval (RM0 in FIG. 6; M0 in FIG. 7) and a spillover interval (RS1, RS2 in FIG. 6; S1 in FIG. 7). The main interval is comprised in the control interval that is assigned to the color component. The spillover interval is comprised in another control interval (T1) that is assigned to another color component (G, which denotes green).

The detailed description hereinbefore further illustrates the following optional characteristics, which are cited in claim 2. The display driver (DDC) can adjust the spillover interval (RS1, RS2 in FIG. 6; S1 in FIG. 7) in response to a user command (UC). This allows a user to find a good compromise between brightness and color saturation.

The detailed description hereinbefore further illustrates the following optional characteristics, which are cited in claim 3. The display driver (DDC) causes the color-light source (RL1, RL2) to apply the color light during an extended interval (RE) that comprises the main interval (M0) and the spillover interval (S1). FIG. 7 illustrates these characteristics, which allow the color-light source to be active during a relatively long, continuous time interval. This contributes to power-efficiency.

The detailed description hereinbefore further illustrates the following optional characteristics, which are cited in claim 4. The display driver (DDC) applies light-transfer control signals (green-display data GD), which correspond to the other color component (which is green G), to the plurality of pixel elements (FLCD) during an active sub-interval (Ta1) within the other control interval (T1). The display driver (DDC) causes the extended interval (RE) to comprise at least a portion of the active subinterval of the other control interval. FIG. 7 illustrates these characteristics, which allow the plurality of pixel elements to receive light during the active subinterval. This further contributes to power-efficiency.

The detailed description hereinbefore further illustrates the following optional characteristics, which are cited in claim 5. The display driver (DDC) is establishes the light-transfer control signals (GD), which correspond to the other color component (G), on the basis of the other color component and, in addition, the color component (R) so as to correct a color error associated with the spillover interval (S1). The color correction circuit, which is illustrated in FIG. 8, is an example. The aforementioned characteristics allow a relatively good image quality.

The detailed description hereinbefore further illustrates the following optional characteristics, which are cited in claim 6. The display driver (DDC) waits during a passive sub-interval (Tp1) within the other control interval (T1) before newly applying light-transfer control signals. The display driver (DDC) causes the color-light source (RL1, RL2) to apply the color light during a further spillover interval (RS1), which is comprised in the passive subinterval of the other control interval. FIG. 10 illustrates these characteristics, which allow even better power-efficiency.

The detailed description hereinbefore further illustrates the following optional characteristics, which are cited in claim 7. The display driver circuit (DDC) applies light-transfer control signals (GD), which correspond to the other color component (G), to the plurality of pixel elements (FLCD) during an active sub-interval (Ta1) within the other control interval (T1) and, subsequently, waits during a passive sub-interval (Tp1) before applying new light-transfer control signals (BD). The display driver circuit (DDC) causes the spillover interval (RS1) to be comprised within the passive subinterval of the other control interval. FIG. 6 illustrates these characteristics, which need no color correction and, therefore, allow relatively cost-efficient implementations.

The detailed description hereinbefore further illustrates the following optional characteristics, which are cited in claim 8. The color-light source (RL1, RL2) comprises a plurality of individually controllable light-emitting elements (signals SR1, SR2 individually control red-light sources RL1, RL2, respectively). An individually controllable light-emitting element (RL1) illuminates various pixel elements (the left-hand portion of the FLCD in FIG. 3) and another individually controllable light-emitting element (RL2) illuminates various other pixel elements (on the right-hand portion of the FLCD in FIG. 3). These characteristics allow different spillover intervals for different display areas, which further contributes to power-efficiency or allows greater user satisfaction, or both.

The aforementioned characteristics can be implemented in numerous different manners. In order to illustrate this, some alternatives are briefly indicated.

There are numerous different types of devices that may form the plurality of elements. For example, a so-called optically-compensated-birefringence type of liquid crystal device may form the plurality of pixel elements. A reflective type of device may also form the plurality of pixel elements. Such a device may be based on a liquid-crystal-on-silicon technique. As another example, a so-called micro-mirror device may also form the plurality of pixel elements. All what matters is that the plurality of pixel elements somehow influences a transfer of light from a source to a display screen. The transfer may be influenced by means of, for example, controllable light-transmission characteristics, controllable light-reflection characteristics, or otherwise. The invention may thus be applied in, for example, a display arrangement based on projection.

Color-light sources may be implemented in numerous different manners. For example, a white-light source in combination with a suitable color filter may form a color light source. Moreover, it is possible to use color components other than red, green, and blue. Alternatively, an image may be formed on the basis of two color components instead of three. Four or more color components are also possible. All what matters is that there are at least two light radiations that have different spectral characteristics. In that sense, white light can be considered as a color component. In case of two color components, one will have a control interval and the other will hand and other control interval. In such a case, there may be a time-sequential color-component pattern that is A-B-A-B-A-B- . . . in which A denotes one color component and B another color component. The time-sequential color-component pattern R-G-B-R-G-B-R-G-B- . . . described hereinbefore is merely an example.

Referring to FIG. 5, which illustrates the display-driver circuit DDC, there are numerous different formats for the multichrome image data ID. The multichrome image data ID may have, for example, the so-called RGB format. The multichrome image data ID may also have, for example, an YC format, which comprises a luminance component and a chrominance component. Any format that somehow defines different color components is possible.

There are numerous ways of implementing functions by means of items of hardware or software, or both. In this respect, the drawings are very diagrammatic, each representing only one possible embodiment of the invention. Thus, although a drawing shows different functions as different blocks, this by no means excludes that a single item of hardware or software carries out several functions. Nor does it exclude that an assembly of items of hardware or software or both carry out a function.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A display arrangement (DAR) comprising:

a plurality of pixel elements (FLCD) that have controllable light-transfer characteristics;

a display driver (DDC) arranged to control the plurality of pixel elements in accordance with a color component (R) during a control interval (T0) that is assigned to the color component, the control interval (T0) having an active sub-interval (Ta0) and a passive sub-interval (Tp0), the display driver (DDC) is constructed for addressing the plurality of pixel elements in accordance with the color component (R) during the active sub-interval (Ta0) to control the light-transfer characteristics of the plurality of pixel elements in accordance with the color component (R) and in the passive sub-interval (Tp0) to achieve and subsequently maintain the light-transfer characteristics in accordance with the color component (R), and being arranged to cause a color-light source (RL1, RL2) to apply a color light, which corresponds to the color component (R), to the plurality of pixel elements during:

a main interval (RM0; M0), which is comprised in the control interval that is assigned to the color component (R); and a spillover interval (RS1; S1), which is comprised in another control interval (T1) that is assigned to another color component (G), the another control interval (T1) having another active sub-interval (Ta1) and another passive sub-interval (Tp1), the display driver (DDC) is constructed for addressing the plurality of pixel elements in accordance with the another color component (G) during the another active sub-interval (Ta1) to control the light-transfer characteristics of the plurality of pixel elements in accordance with the another color component (G) and in the another passive sub-interval (Tp1) to achieve and subsequently maintain the light-transfer characteristics in accordance with the another color component (G).

2. A display arrangement as claimed in claim 1, wherein the display driver (DDC) is arranged to adjust the spillover interval (RS1; S1) in response to a user command (UC).

3. A display arrangement as claimed in claim 1, wherein the color-light source (RL1, RL2) comprises a plurality of individually controllable light-emitting elements, an individually controllable light-emitting element (RL1) being arranged to illuminate various pixel elements and another individually controllable light-emitting element (RL2) being arranged to illuminate various other pixel elements.

4. A display arrangement as claimed in claim 1, wherein the plurality of pixel elements (FLCD) comprises a liquid-crystal-type device.

5. A video apparatus (PVA) comprising:

a receiver circuit (CPC) arranged to provide multichrome image data (ID), which comprises various color components, in response to reception signal (RFI); and a display arrangement (DAR) as claimed in claim 1 so as to display an image on the basis of the multichrome image data.

6. A display arrangement as claimed in claim 1, wherein the spillover interval (RS1; S1) occurs within the another active sub-interval (Ta1).

7. A display arrangement as claimed in claim 1, wherein the spillover interval (RS1; S1) occurs within the another passive sub-interval (Tp1).

8. A display arrangement (DAR) comprising:

a plurality of pixel elements (FLCD) that have controllable light-transfer characteristics;

a display driver (DDC) arranged to control the plurality of pixel elements in accordance with a color component (R) during a control interval (T0) that is assigned to the color component, and being arranged to cause a color-light source (RL1, RL2) to apply a color light, which corresponds to the color component, to the plurality of pixel elements during:

a main interval (RM0; M0), which is comprised in the control interval that is assigned to the color component; and a spillover interval (RS1; S1), which is comprised in another control interval (T1) that is assigned to another color component (G); wherein the display driver (DDC) is arranged to cause the color-light source (RL1, RL2) to apply the color light during an extended interval (RE) that comprises the main interval (M0) and the spillover interval (S1).

9. A display arrangement as claimed in claim 8, wherein the display driver (DDC) is arranged to apply light-transfer control signals (GD), which correspond to the other color component (G), to the plurality of pixel elements (FLCD) during an active sub-interval (Ta1) within the other control interval (T1), the display driver (DDC) being arranged to cause the extended interval (RE) to comprise at least a portion of the active subinterval of the other control interval.

10. A display arrangement as claimed in claim 9, wherein the display driver (DDC) is arranged to establish the light-transfer control signals (GD), which correspond to the other color component (G), on the basis of the other color component and, in addition, the color component (R) so as to correct a color error associated with the spillover interval (S1).

11. A display arrangement as claimed in claim 9, wherein the display driver (DDC) is arranged to wait during a passive sub-interval (Tp1) within the other control interval (T1) before newly applying light-transfer control signals, the display driver (DDC) being arranged to cause the color-light source (RL1, RL2) to apply the color light during a further spillover interval (RS1), which is comprised in the passive subinterval of the other control interval.

12. A display arrangement (DAR) comprising:

a plurality of pixel elements (FLCD) that have controllable light-transfer characteristics;

a display driver (DDC) arranged to control the plurality of pixel elements in accordance with a color component (R) during a control interval (T0) that is assigned to the color component, and being arranged to cause a color-light source (RL1, RL2) to apply a color light, which corresponds to the color component, to the plurality of pixel elements during:

a main interval (RM0; M0), which is comprised in the control interval that is assigned to the color component; and a spillover interval (RS1; S1), which is comprised in another control interval (T1) that is assigned to another color component (G);

wherein the display driver circuit (DDC) is arranged to apply light-transfer control signals (GD), which correspond to the other color component (G), to the plurality of pixel elements (FLCD) during an active sub-interval (Tal) within the other control interval (T1) and, subsequently, to wait during a passive sub-interval (Tp1) before applying new light-transfer control signals (BD), the display driver circuit (DDC) being arranged to cause the spillover interval (RS1) to be comprised within the passive subinterval of the other control interval.

13. An image-display method that employs a display arrangement comprising (DAR) a plurality of pixel elements (FLCD) that have controllable light-transfer characteristics, the image-display method comprising:

a pixel-element control step (CTRL, CDR, LDR) in which the plurality of pixel elements are controlled in accordance with a color component (R) during a control interval (T0) that is assigned to the color component the control interval (T0) having an active sub-interval (Ta0) and a passive sub-interval (Tp0), the pixel-element control step (CTRL, CDR, LDR) addresses the plurality of pixel elements in accordance with the color component (R) during the active sub-interval (Ta0) to control the light-transfer characteristics of the plurality of pixel elements in accordance with the color component (R) and, in the passive sub-interval (Tp0), achieves and subsequently maintains the light-transfer characteristics in accordance with the color component (R); and a light-source control step (CTRL, SDR) in which a color-light source (RL1, RL2) is made to apply a color light, which corresponds to the color component, to the plurality of pixel elements during:

a main interval (RM0; M0), which is comprised in the control interval that is assigned to color component; and a spillover interval (RS1; S1), which is comprised in another control interval (T1) that is assigned to another color component (G), the another control interval (T1) having another active sub-interval (Ta1) and another passive sub-interval (Tp1), the pixel-element control step (CTRL, CDR, LDR) addresses the plurality of pixel elements in accordance with the another color component (G) during the another active sub-interval (Ta1) to control the light-transfer characteristics of the plurality of pixel elements in accordance with the another color component (G) and, in the another passive sub-interval (Tp1), achieves and subsequently maintains the light-transfer characteristics in accordance with the another color component (G).

* * * * *